US005103797A

United States Patent [19]

Newbold

[11] Patent Number: 5,103,797

[45] Date of Patent: Apr. 14, 1992

[54] ARROW REST APPARATUS

[75] Inventor: George T. Newbold, Walla Walla, Wash.

[73] Assignee: Martin Archery, Inc., Walla Walla, Wash.

[21] Appl. No.: 665,467

[22] Filed: Mar. 6, 1991

Related U.S. Application Data

[63] Continuation-in-part of Ser. No. 638,042, Jan. 4, 1991, abandoned.

[51] Int. Cl.[5] ..... F41B 5/22

[52] U.S. Cl. ..... 124/44.5; 124/24.1

[58] Field of Search ..... 124/44.5, 24.1, 41.1

[56] References Cited

U.S. PATENT DOCUMENTS

| | | | |
|---|---|---|---|
| 3,108,584 | 10/1963 | Coe | 124/24.1 |
| 3,292,607 | 12/1966 | Hoyt, Jr. | 124/44.5 |
| 3,828,757 | 8/1974 | Finlay | 124/44.5 |
| 3,871,352 | 3/1975 | Stanislawski et al. | 124/41.1 |
| 4,476,846 | 10/1984 | Carville | 124/44.5 |
| 4,686,956 | 8/1987 | Troncoso, Jr. | 124/44.5 |
| 4,889,102 | 12/1989 | Martin | 124/44.5 |
| 4,899,716 | 2/1990 | Martin et al. | 124/44.5 |
| 5,062,407 | 11/1991 | Newbold | 124/44.5 |
| 5,065,731 | 11/1991 | Smith | 124/44.5 |

*Primary Examiner*—Peter M. Cuomo

*Attorney, Agent, or Firm*—Wells, St. John & Roberts

[57] ABSTRACT

An adjustable arrow rest apparatus comprises a base which is mountable to an archery bow handle and an elongated support bar extending therefrom. An arrow launcher assembly is movably mounted to the support bar for lateral movement. The support bar has an elongated slot formed longitudinally therein at a selected position between its outer and inner ends. The longitudinal slot has opposed relative outer and inner terminuses. A longitudinal opening is formed through the outer terminus and communicates with the slot. A threaded rod is slidably received through the outer terminus opening and passes longitudinally within and along the slot. The threaded rod is secured in a manner which precludes sliding of the threaded rod through the outer terminus opening and along the slot, yet enables rotation of the threaded rod within the outer terminus opening and slot. An adjustment block is received within the slot, and has a threaded bore through which the threaded rod is threadedly received. Rotation of the threaded rod imparts movement of the adjustment block within and along the slot. The adjustment block has a projection which extends generally radially relative to the orientation of the threaded rod. The projection engages the arrow launcher assembly to impart lateral movement thereto along the support bar as the threaded rod is rotated.

16 Claims, 5 Drawing Sheets

ARROW REST APPARATUS

RELATED APPLICATION DATA

This patent resulted from a continuation-in-part application of U.S. patent application Ser. No. 07/638,042, filed Jan. 4, 1991, now abandoned.

TECHNICAL FIELD

This invention relates to arrow rests for archery bows.

BACKGROUND OF THE INVENTION

Arrow rests are typically attached to an archery bow for supporting an arrow before and during release. Many arrow rests allow lateral adjustment so that the arrow rest may be aligned with a drawn bowstring, and to adapt to the shooting and aiming styles of different archers. Many arrow rests as well allow for angular and fore/aft adjustments. It is desirable to make lateral adjustments without affecting these and other adjusted settings.

To provide such lateral adjustments, some popular arrow rests use a lateral support bar upon which an arrow launcher support block is slidably mounted. Such an arrow rest is shown in our U.S. Pat. No. 4,899,716, which is herein incorporated by reference. This type of structure allows the support block to slide laterally along the lateral support bar without changing other settings. An arrow launcher is typically attached to the support block to support an arrow. A set screw is used in the support block to engage the lateral support bar to secure the support block in a desired lateral position.

It would be desirable for an arrow rest design to provide finer lateral adjustments than those possible when simply sliding such a support block laterally by hand, and to improve upon such constructions in the prior art.

BREIF DESCRIPTION OF THE DRAWINGS

Preferred embodiments of the invention are illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
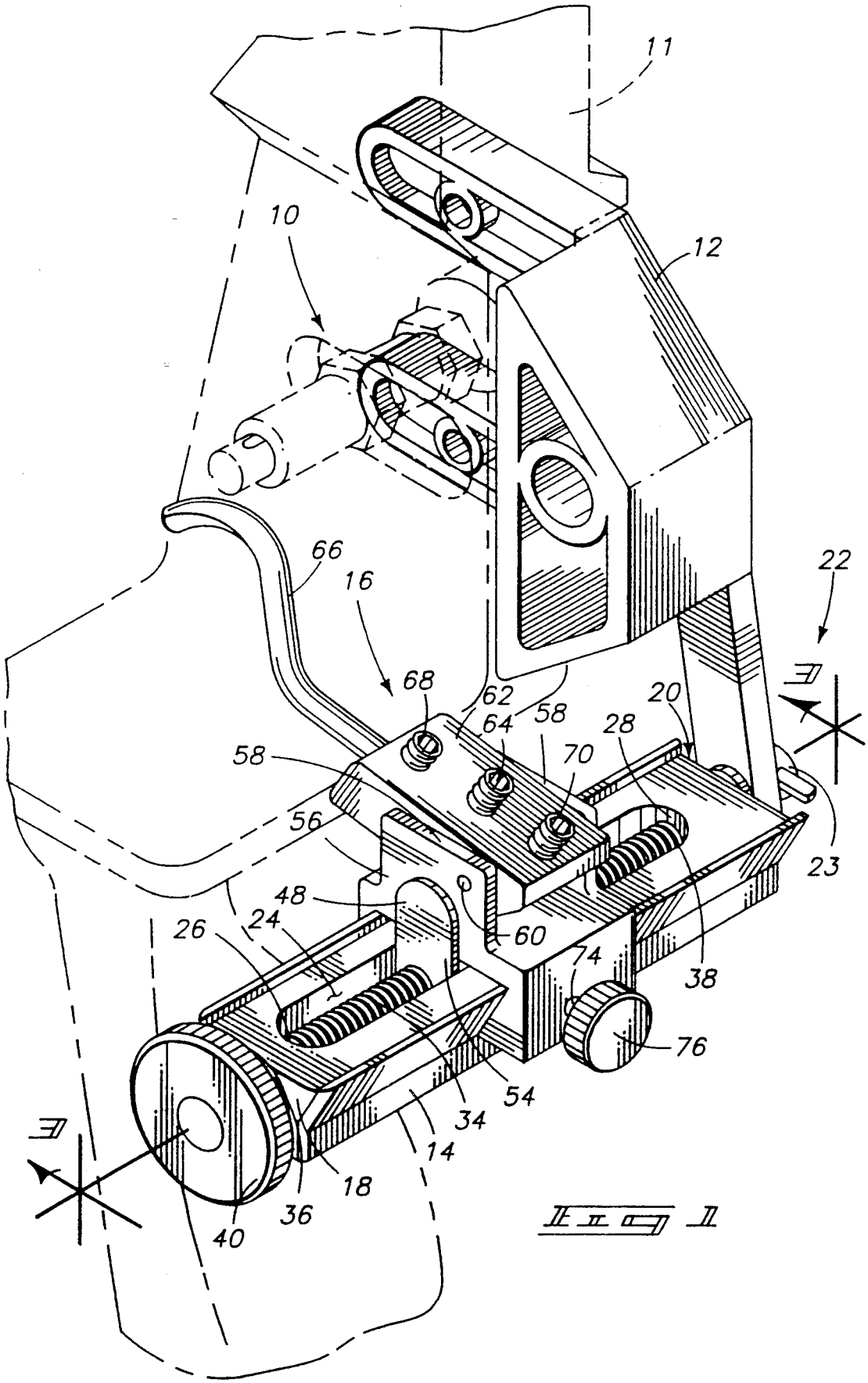
FIG. 1 is a left rear, downward perspective view of a preferred embodiment arrow rest apparatus in accordance with the invention, the arrow rest being mounted to an archery bow handle which is shown in phantom.
Figure 2:
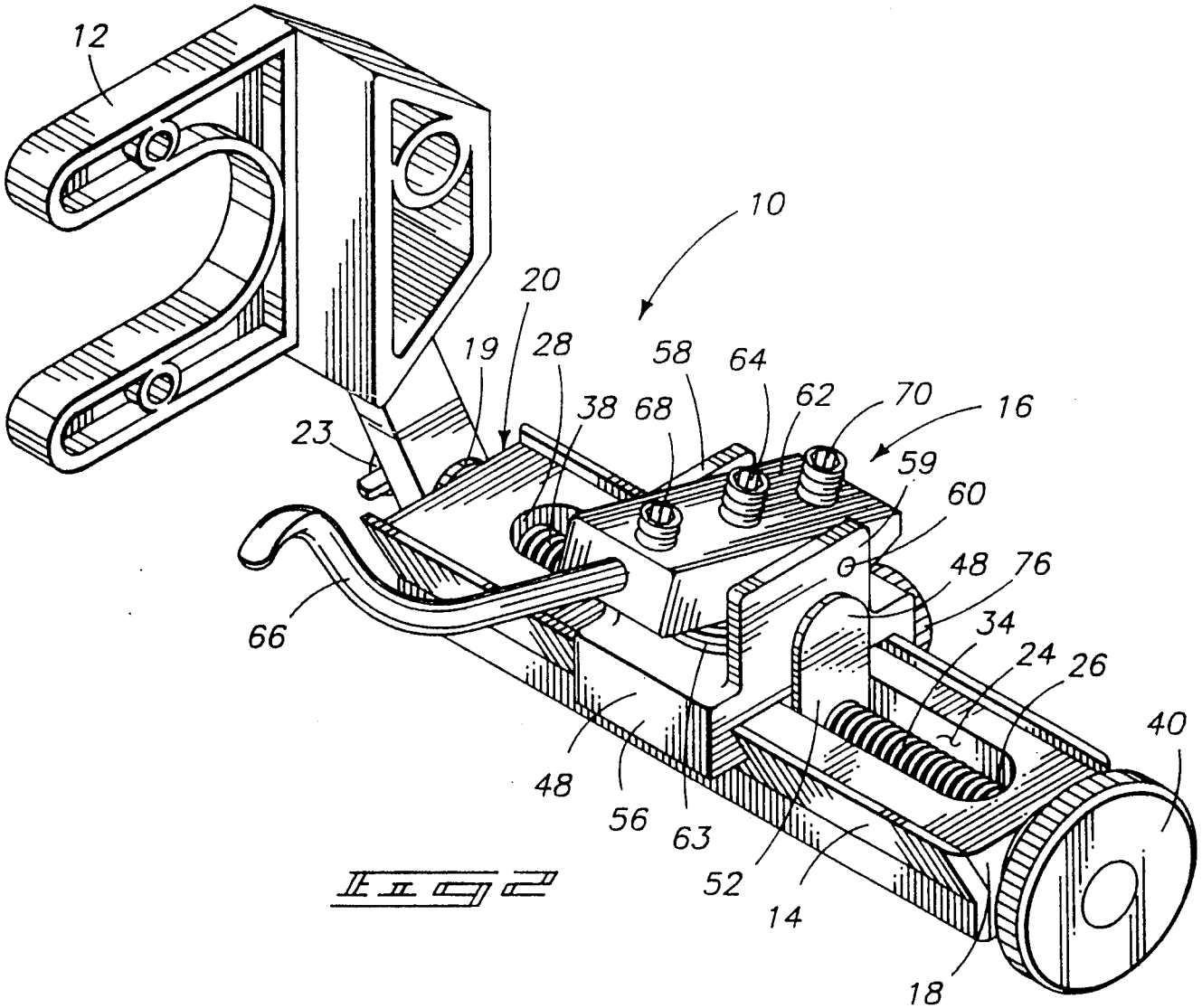
FIG. 2 is a left front, downward and enlarged perspective view of the arrow rest illustrated in FIG. 1.
Figure 3:
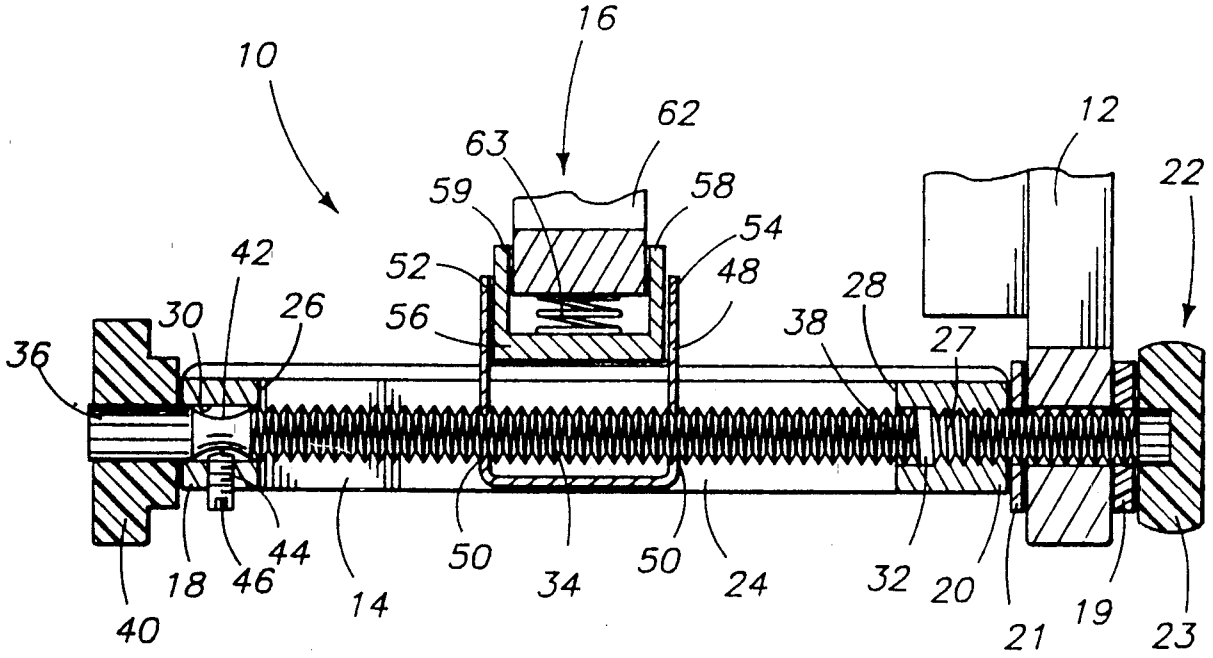
FIG. 3 is an enlarged cross-sectional view taken along line 3—3 in FIG. 1.

Referring to FIGS. 1-3, a first embodiment arrow rest apparatus for mounting to a handle of an archery bow is indicated generally by reference numeral 10. Arrow rest apparatus 10 includes a base or mounting bracket 12 and an elongated support bar 14 which extends generally laterally therefrom. An arrow launcher assembly 16 is movably mounted to support bar 14 for lateral movement therealong. Base 12 attaches to an archery bow handle 11 (FIG. 1) having opposed recessed mounting slots (not shown). Such a bow handle is described and illustrated in our U.S. Pat. No. 4,889,102, which is also herein incorporated by reference. Alternate mounting brackets could of course be used without departing from the principles and scope of the invention. One such example alternate mounting bracket is illustrated in our U.S. Pat. No. 4,899,716.

More specifically, support bar 14 has a male dovetail-shaped lateral cross-section having outer and inner opposed ends 18, 20, respectively. Inner end 20 is mounted to bracket 12 and is angularly adjustable relative thereto by means of a bolt and washer assembly 22. Bolt assembly 22 extends through mounting bracket 12 and into a threaded hole 27 formed in end 20 of support bar 14. (FIG. 3). Bolt assembly 22 has a winged head 23 so that it can be easily tightened by hand. Nylon and lock washers 19, 21 respectively, are provided as shown. When bolt assembly 22 is loosened, it serves as a pivoting-like mount and allows an archer to quickly and easily adjust the angular position of support bar 14 relative to base 12 and correspondingly bow handle 11. Once support bar 12 has been adjusted, bolt assembly 22 may be tightened sufficiently to lock support bar 14 in place.

Support bar 14 is provided with an elongated slot 24 extending longitudinally therealong at a selected position between support bar outer end 18 and support bar inner end 20. Slot 24 is closed at both ends, having opposed relative outer and inner terminuses 26, 28 defined by remainder inner and outer portions of the support bar beyond slot 24. Outer and inner support bar portions or terminuses 26, 28, respectively, have respective longitudinal openings 30, 32 (FIG. 3) which extend therethrough and communicate with slot 24. Further, openings 30, 32 are aligned with one another at opposite ends of the slot. Opening 32 is axially aligned with threaded opening 27 for bolt assembly 22 which locks support bar 14 relative to base 12.

A threaded rod 34 is slidably received from outer support bar end 18 through outer terminus opening 30, through slot 24, and into inner terminus opening 32. Threaded rod 34 is slidably received through openings 30 and 32 and is supported by the bulk mass of both terminus portions 26, 28. Threaded rod 34 is defined by outer and inner rod ends 36, 38 respectively. An adjustment knob 40 is provided on outer end 36 for imparting rotational movement thereto. Securing means are provided for precluding sliding of threaded rod 34 through openings 30, 32 and along slot 24, yet enabling rotation of threaded rod 34 within openings 30, 32 and slot 24.

More particularly, an annular recess 42 is formed about threaded rod 34 adjacent outer rod end 36 inward of knob 40, and at a location that will place recess 42 within outer longtudinal support bar opening 30. (FIG. 3). A threaded opening 44 is formed transversely within and from the underside of support bar 14 and communicates in a transverse manner with rod 34 within support bar opening 30. A locking screw 46 is threadedly received within transverse threaded opening 44. Locking screw 46 and annular recess 42 are complementarily sized such that locking screw 46 is loosely received within recess 42. In this manner, rotation of rod 40 is permitted while the engagement of recess 42 and locking screw 46 precludes sliding movement of rod 34 relative to support bar 14. Were locking screw 46 tightly threaded against rod 34, rotation of rod 34 would be precluded or at least severely inhibited.

An adjustment member or block element 48 is received within slot 24 and includes threaded bores 50 through which threaded rod 34 is threadedly received. Rotation of threaded rod 34 imparts movement of adjustment block 48 within and along slot 24 by the result of such threaded engagement. The adjustment block includes a projection which extends generally radially relative to the threaded rod, with the projection engaging the arrow launcher assembly to impart lateral movement relative thereto along the support bar as the threaded rod is rotated. More particularly, adjustment block 48 is comprised of a generally U-shaped member which is threadedly received by threaded rod 43 and projects upwardly from within slot 24. Such defines a pair of projections 52, 54 forming the "U" which cradles arrow launcher assembly 16 therebetween and engages opposed outer lateral sides thereof. Rotation of threaded rod 34 imparts movement of adjustment block 48 within and along slot 24 and transfers such movement directly to arrow launcher assembly 16 for precise lateral adjustment thereof.

Arrow launcher assembly 16 could be of any particular design having a female dovetail shaped slot which is complementary in shape to receive or be received by the male dovetail shaped cross section of support bar 14. In the depicted embodiment, arrow launcher assembly 16 is comprised of a support block 56 having a pair of upwardly projecting side walls 58, 59 and a pivot pin 60 extending therebetween. A launcher block 62 is pivotally received between side walls 58, 59 by pivot pin 60. Its forward end is upwardly biased by a spring 63 whose tension is adjustable by means of a set screw 64.

A thumb shaped arrow launcher 66 is received within a longitudinal opening in the fore end of launcher block 62, and secured therein by means of a locking set screw 68. A set screw 70 is provided in the aft end of launcher block 62 for adjustable engagement with support block 56 for adjusting the angular orientation of launcher block 62 and correspondingly the elevation of the uppermost portion of arrow launcher 66.

A locking set screw 74 is threadedly received in the aft end of support block 56, and is positioned to engage the aft longitudinal edge of lateral support bar 14. Set screw 74 is used to selectively lock support block 56 at a selected lateral position along arrow rest lateral support bar 14 as determined by selective rotation of threaded rod 34. Set screw 74 has an enlarged head 76 to allow for easy loosening and tightening. This relative engagement functions as a locking means for selectively locking adjustment block 48 at a selected lateral position along support bar 14. Alternately but less preferred, set screw 46 could be selectively tightened and loosened against threaded rod 34 for functioning as such a locking means.

The components herein described can be constructed from any suitable materials, and are preferably fabricated using various metals (such as aluminum), plastics, and plastic-like materials.

The preferred construction of launcher assembly 16 and its mounting relative to support block 56 is shown, described and claimed in our U.S. Pat. No. 4,899,716. One difference illustrated by the embodiment of this disclosure relates to arrow launcher 66. Launcher 66 is of the type which would be utilized in connection with a side pressure button or burger button 72 (FIG. 1) for engaging the side of an arrow upon release. A launcher assembly such as shown in our U.S. Pat. No. 4,899,716 or any alternate launcher could of course be utilized without departing from the principles and the scope of this invention.

Figure 4:
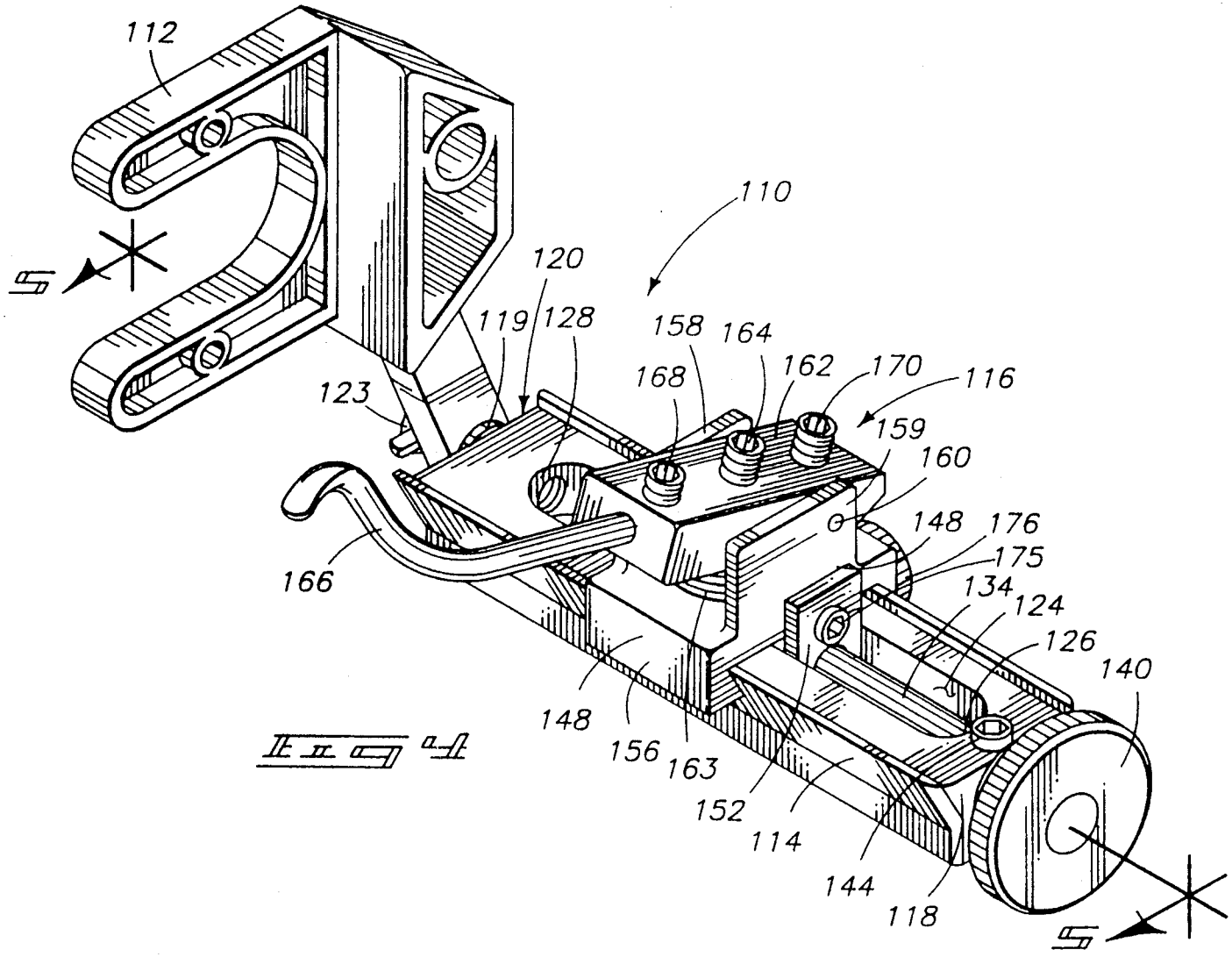
FIG. 4 is a left front, downward perspective view of an alternate preferred embodiment arrow rest apparatus in accordance with the invention.
Figure 5:
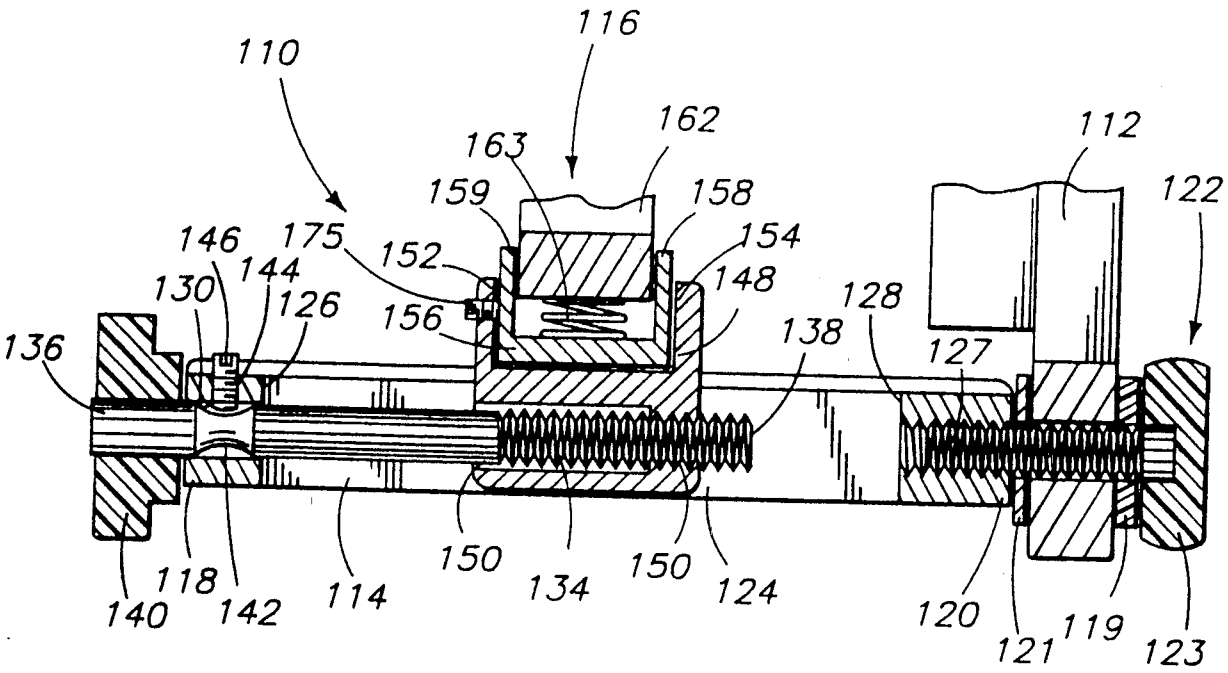
FIG. 5 is an enlarged cross-sectional view of the FIG. 4 embodiment taken along line 5—5 in FIG. 4.

Referring to FIGS. 4 and 5, a second preferred embodiment arrow rest apparatus for mounting to a handle of an archery bow is indicated generally by reference numeral 110. Arrow rest apparatus 110 includes a base or mounting bracket 112 and an elongated support bar 114 which extends generally laterally therefrom. An arrow launcher assembly 116 is movably mounted to support bar 114 for lateral movement therealong. Base 112 would attach to an archery bow handle (not shown) having opposed recessed mounting slots, as described above with reference to the first embodiment.

Support bar 114 has a male dovetail-shaped lateral cross-section having outer and inner opposed ends 118, 120, respectively. Inner end 120 is mounted to bracket 112 and is angularly adjustable relative thereto by means of a bolt and washer assembly 122. Bolt assembly 122 extends through mounting bracket 112 and into a threaded hole 127 formed in end 120 of support bar 114. (FIG. 5). Bolt assembly 122 has a winged head 123 so that it can be easily tightened by hand. Nylon and lock washers 119, 121 respectively, are provided as shown. When bolt assembly 122 is loosened, it serves as a pivoting-like mount and allows an archer to quickly and easily adjust the angular position of support bar 114 relative to base 112 and correspondingly to the bow handle. Once support bar 112 has been adjusted, bolt assembly 122 may be tightened sufficiently to lock support bar 114 in place.

Support bar 114 is provided with an elongated slot 124 extending longitudinally therealong at a selected position between support bar outer end 118 and support bar inner end 120. Slot 124 is closed at both ends, having opposed relative outer and inner terminuses 126, 128 defined by remainder inner and outer portions of the support bar beyond slot 124. Outer support bar portion or terminus 126 has a longitudinal opening 130 (FIG. 5) which extends therethrough and communicates with slot 124.

A threaded rod 134 is slidably received from outer support bar end 118 through outer terminus opening 130 and into slot 124. Threaded rod 134 is slidably received through opening 130, and is supported by the bulk mass of terminus portions 126. Threaded rod 134 is defined by outer and inner rod ends 136, 138 respectively. Rod 134 is threaded from inner end 138 partially along its length. An adjustment knob 140 is provided on outer end 136 for imparting rotational movement thereto. Securing means are provided for precluding sliding of threaded rod 134 through opening 130 and along slot 124, yet enabling rotation of threaded rod 134 within opening 130 and slot 124.

More particularly, an annular recess 142 is formed about threaded rod 134 adjacent outer rod end 136 inward of knob 140, and at a location that will place recess 142 within outer longitudinal support bar opening 130. (FIG. 5). A threaded opening 144 is formed transversely within and from the topside of support bar 114 and communicates in a transverse manner with rod 134 within support bar opening 130. A locking screw 146 is threadedly received within transverse threaded opening 144. Locking screw 146 and annular recess 142 are complementarily sized such that locking screw 146 is loosely received within recess 42. In this manner, rotation of rod 140 is permitted while the engagement of recess 142 and locking screw 146 precludes sliding movement of rod 134 relative to support bar 114. Were locking screw 146 tightly threaded against rod 134, rotation of rod 134 would be precluded or at least severely inhibited.

An adjustment member or block element 148 is received within slot 124. Adjustment block 148 includes a threaded bore 150 through which threaded rod 134 is threadedly received. Rotation of threaded rod 134 imparts movement of adjustment block 148 within and along slot 124 by the result of such threaded engagement. The adjustment block includes a projection which extends generally radially relative to the threaded rod, with the projection engaging the arrow launcher assembly to impart lateral movement relative thereto along the support bar as the threaded rod is rotated.

More particularly, adjustment block 148 is comprised of a generally U-shaped member as shown which is threadedly received by threaded rod 143 and projects upwardly from within slot 124. Such defines a pair of projections 152, 154 forming the "U" which cradles arrow launcher assembly 116 therebetween and engages opposed outer lateral sides thereof. Rotation of threaded rod 134 imparts movement of adjustment block 148 within and along slot 124 and transfers such movement directly to arrow launcher assembly 116 for precise lateral adjustment thereof. Adjustment block 148 includes a locking set screw 175 threaded through an opening in projection 152. The set is engageable against one lateral side of the arrow launcher assembly 116 for locking the arrow launcher assembly relative to the adjustment block.

Arrow launcher assembly 116 could be of any particular design having a female dovetail shaped slot which is complementary in shape to receive or be received by the male dovetail shaped cross section of support bar 114. The embodiment depicted in FIGS. 4 and 5 is substantially the same as that depicted in FIGS. 1-3. Specifically, arrow launcher assembly 116 is comprised of a support block 156 having a pair of upwardly projecting side walls 158, 159 and a pivot pin 160 extending therebetween. A launcher block 162 is pivotally received between side walls 158, 159 by pivot pin 160. Its forward end is upwardly biased by a spring 163 whose tension is adjustable by means of a set screw 164.

A thumb shaped arrow launcher 166 is received within a longitudinal opening in the fore end of launcher block 162, and secured therein by means of a locking set screw 168. A set screw 170 is provided in the aft end of launcher block 162 for adjustable engagement with support block 156 for adjusting the angular orientation of launcher block 162 and correspondingly the elevation of the uppermost portion of arrow launcher 166.

A locking set screw 176 is threadedly received in the aft end of support block 156, and is positioned to engage the aft longitudinal edge of lateral support bar 114. Set screw 176 is used to selectively lock support block 156 at a selected lateral position along arrow rest lateral support bar 114 as determined by selective rotation of threaded rod 134. This relative engagement functions as a locking means for selectively locking adjustment block 148 at a selected lateral position along support bar 114. Alternately but less preferred, set screw 146 could be selectively tightened and loosened against threaded rod 134 for functioning as such a locking means.

In compliance with the statute, the invention has been described in language more or less specific as to structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An adjustable arrow rest apparatus for mounting to a handle of an archery bow, the apparatus comprising:

a base which is mountable to an archery bow handle;

an elongated support bar extending from the base;

an arrow launcher assembly movably mounted to the support bar for lateral movement therealong, the arrow launcher assembly having at least one lateral side;

a threaded rod rotatably mounted along the elongated support bar;

an adjustment block having at least one projection positioned to engage the lateral side of the arrow launcher assembly, the adjustment block having a threaded bore which threadedly receives the threaded rod, wherein rotating the threaded rod moves the adjustment block laterally along the support bar, the projection engaging the lateral side of the arrow launcher assembly to impart lateral movement of the arrow launcher assembly along the support bar as the threaded rod is rotated.

2. The adjustable arrow rest apparatus of claim 1 wherein the arrow launcher assembly has two lateral sides and the adjustment block has two projections, each projection being positioned to engage one of the lateral sides to impart lateral movement of the arrow launcher assembly along the support bar as the threaded rod is rotated.

3. The adjustable arrow rest apparatus of claim 1 wherein the arrow launcher assembly has two opposed lateral sides and the adjustment block has two projections, each projection engaging one of the lateral sides, the adjustment block cradling the arrow launcher assembly between the two projections.

4. The adjustable arrow rest apparatus of claim 1 further comprising locking means for selectively locking the arrow launcher assembly at a selected lateral position along the support bar.

5. The adjustable arrow rest apparatus of claim 1 further comprising locking means positioned on the arrow launcher assembly and apart from the threaded rod for selectively locking the arrow launcher assembly at a selected lateral position along the support bar.

6. The adjustable arrow rest apparatus of claim 1 wherein the elongated support bar has an elongated slot formed longitudinally therein, the adjustment block being mounted for moving laterally within the slot.

7. The adjustable arrow rest apparatus of claim 1 wherein:

the elongated support bar has an elongated slot formed longitudinally therein, the adjustment block being mounted for moving laterally within the slot;

the arrow launcher assembly includes a female dovetail-shaped slot;

the elongated support bar has a male dovetail-shaped lateral cross-section, the male dovetail-shaped cross-section being complementary in shape to receive the female dovetail-shaped slot of the arrow launcher assembly.

8. An adjustable arrow rest apparatus for mounting to a handle of an archery bow, the apparatus comprising:

a base which is mountable to an archery bow handle;

an elongated support bar extending from the base, the support bar having opposed outer and inner ends;

an arrow launcher assembly movably mounted to the support bar for lateral movement therealong, the arrow launcher assembly having opposed lateral sides;

the support bar having an elongated slot formed longitudinally therein at a selected position between the support bar outer and inner ends, the longitudinal slot having opposed relative outer and inner terminuses, the outer and inner terminuses each having an opening formed therein which communicates with the slot and aligns with the opening of the opposed terminus;

a threaded rod received within the slot, the threaded rod being slidably received through the outer and inner terminus openings and being supported by the outer and inner terminuses;

securing means for precluding sliding of the threaded rod through the terminus openings and along the slot yet enabling rotation of the threaded rod within the terminus openings and slot;

a generally U-shaped member received within the slot and projecting upwardly from the slot to cradle the arrow launcher assembly, the U-shaped member having a threaded bore through which the threaded rod is threadedly received, the U-shaped member engaging the opposed lateral sides of the arrow launcher assembly to impart lateral movement to the arrow launcher assembly along the support bar as the threaded rod is rotated; and locking means for selectively locking the arrow launcher assembly at a selected lateral position along the support bar.

9. The adjustable arrow rest apparatus of claim 8 wherein the securing means comprises:

an annular recess formed about the threaded rod;

a threaded opening formed transversely within one terminus and communicating transversely with the one terminus opening; and a locking screw threadedly received within the transverse threaded opening, the locking screw being loosely received within the threaded rod annular recess to allow the threaded rod to rotate relative to the elongated support bar.

10. The adjustable arrow rest apparatus of claim 8 wherein the locking means is positioned on the arrow launcher assembly and apart from the threaded rod.

11. The adjustable arrow rest apparatus of claim 8 wherein the locking means is positioned on the arrow launcher assembly and apart from the threaded rod; and wherein the securing means comprises:

an annular recess formed about the threaded rod;

a threaded opening formed transversely within one terminus and communicating transversely with the one terminus opening; and a locking screw threadedly received within the transverse threaded opening, the locking screw being loosely received within the threaded rod annular recess to allow the threaded rod to rotate relative to the elongated support bar.

12. An adjustable arrow rest apparatus for mounting to a handle of an archery bow, the apparatus comprising:

a base which is mountable to an archery bow handle;

an elongated support bar extending from the base, the support bar having opposed outer and inner ends;

an arrow launcher assembly movably mounted to the support bar for lateral movement therealong, the arrow launcher assembly having opposed lateral sides;

the support bar having an elongated slot formed longitudinally therein at a selected position between the support bar outer and inner ends, the longitudinal slot being closed at both ends and thereby having opposed relative outer and inner terminuses, the outer terminus having an opening formed therein which communicates longitudinally with the slot;

a threaded rod slidably received from the outer support bar end through the outer terminus opening and extending within the slot;

securing means for precluding sliding of the threaded rod through the outer terminus opening and along the slot yet enabling rotation of the threaded rod within the outer terminus opening and slot;

a generally U-shaped member received within the slot and projecting upwardly from the slot to cradle the arrow launcher assembly, the U-shaped member having a threaded bore through which the threaded rod is threadedly received, the U-shaped member engaging the opposed lateral sides of the arrow launcher assembly to impart lateral movement to the arrow launcher assembly along the support bar as the threaded rod is rotated; and locking means for selectively locking the arrow launcher assembly at a selected lateral position along the support bar.

13. The adjustable arrow rest apparatus of claim 12 wherein the securing means comprises:

an annular recess formed about the threaded rod;

a threaded opening formed transversely within through the outer terminus and communicating transversely with the outer terminus opening; and a locking screw threadedly received within the transverse threaded opening, the locking screw being loosely received within the threaded rod annular recess to allow the threaded rod to rotate relative to the elongated support bar.

14. The adjustable arrow rest apparatus of claim 12 wherein the U-shaped member includes a locking set screw, the set screw being engageable against one lateral side of the arrow launcher assembly for locking the arrow launcher assembly relative to the adjustment block.

15. The adjustable arrow rest apparatus of claim 12 wherein the arrow launcher assembly includes a female dovetail-shaped slot, the support bar having a male dovetail-shaped lateral cross-section, the male dovetail-shaped cross section being complementary in shape to receive the female dovetail-shaped slot of the arrow launcher assembly.

16. The adjustable arrow rest apparatus of claim 12 wherein the locking means is positioned on the arrow launcher assembly and apart from the threaded rod.

* * * * *